US005553565A

United States Patent [19]

Ono et al.

[11] Patent Number: 5,553,565

[45] Date of Patent: Sep. 10, 1996

[54] WORK MOVING DEVICE IN SEWING MACHINE

[75] Inventors: Yasushi Ono; Yojiro Takase; Minoru Wada, all of Tokyo, Japan

[73] Assignee: Juki Corporation, Tokyo, Japan

[21] Appl. No.: 503,690

[22] Filed: Jul. 18, 1995

[30] Foreign Application Priority Data

Jul. 19, 1994 [JP] Japan ..... 6-188847

[51] Int. Cl.[6] ..... D05B 21/00; F16H 1/18

[52] U.S. Cl. ..... 112/470.18; 74/424.6; 74/27

[58] Field of Search ..... 112/470.18, 103, 112/470.06, 470.14, 220, 102, 102.5; 271/225, 254; 198/377, 465.3; 33/23.01, 23.03; 74/22 A, 27, 31, 37, 45, 49, 422, 424.5, 424.6

[56] References Cited

U.S. PATENT DOCUMENTS

| | | | |
|---|---|---|---|
| 4,152,994 | 5/1979 | Sugiyama | 112/470.06 |
| 4,312,282 | 1/1982 | Dorosz et al. | 112/470.18 |
| 4,602,578 | 7/1986 | Yokoe et al. | 112/470.18 |
| 5,003,895 | 4/1991 | Talanker | 112/470.06 X |
| 5,127,348 | 7/1992 | Scholl et al. | 112/470.18 |

FOREIGN PATENT DOCUMENTS

| | | |
|---|---|---|
| 62-139693 | 6/1987 | Japan . |
| WO82/04076 | 11/1982 | WIPO . |

*Primary Examiner*—Ismael Izaguirre
*Attorney, Agent, or Firm*—Morgan, Lewis and Bockius LLP

[57] ABSTRACT

In a sewing machine which moves a work to be sewed with respect to a sewing needle which stitches a seam on the work, a work moving device includes: a pair of stationary racks spaced from each other, the stationary racks being set in parallel with each other in a first direction of moving the work; a coupling shaft having gears engaged with the stationary racks, respectively; coupling shaft driver for rotating the coupling shaft; a movable frame rotatably supporting the coupling shaft, the movable frame being movable back and forth in the first direction according to rotating the coupling shaft; a carriage supported by the movable frame, the carriage being movable back and forth in a second direction perpendicular to the first direction; a carriage driver for moving the carriage back and forth in the second direction; and a pallet supported by the carriage, for carrying the work.

8 Claims, 3 Drawing Sheets

WORK MOVING DEVICE IN SEWING MACHINE

BACKGROUND OF THE INVENTION

This invention relates to a work moving device for a sewing machine.

Conventionally, an electronic cycle sewing machine has a work moving device which moves a work-to-be-sewed (or workpiece) with respect to the sewing needle according to the given sewing data in a pattern stitching operation. A variety of work moving devices of this type have been proposed in the art. Work moving devices which have been disclosed, for instance, by Unexamined Japanese Patent Publication No. Sho. 58-500744 and Examined Japanese Patent Publication No. Hei. 1-45395 are well known in the art.

The device disclosed by Unexamined Japanese Patent Publication Sho. 58-500744 has a frame which moves on a pair of guides at a predetermined height. The frame has a movement axis which is extended laterally with respect to the direction of movement of the frame. A carriage is provided in such a manner that it is movable along the movement axis. The carriage is used to position a work with respect to the sewing needle which is moved back and forth, including for instance a holder adapted to support the work. More specifically, the carriage is provided with a pair of gear racks which are coupled to the frame and extend in the direction of movement of the frame and a drive mechanism for driving the gear racks so that two drive forces are applied to the frame through the gear racks.

The device disclosed by Examined Japanese Patent Publication No. Hei. 1-45395 comprises: a pallet which positions a work in place with respect to a sewing machine body having seam forming means; a carriage on which the pallet is detachably supported; a movable frame on which the carriage is supported in such a manner that it is moved back and forth in one direction; a pair of stationary racks with guide members which are provided below both ends of the movable frame in such a manner that they extend in a direction perpendicular to the direction of movement of the carriage; a shaft having a pair of gears at both ends which are engaged with the stationary racks, the shaft being rotatably supported on the movable frame; a sliding body which is provided on the movable frame, the sliding body being guided on the aforementioned guide members so that the movable frame is moved along the guide members; a drive rack which is fixedly provided substantially at the middle of the movable frame in such a manner that it is extended in parallel with the stationary racks; a first electric motor which engages with the drive rack to drive the latter together with the movable frame; and a second electric motor which is so arranged as to drive the aforementioned carriage in a direction perpendicular to the direction of movement of the movable frame.

The above-described work moving devices have several problems. In the former device (disclosed by Unexamined Japanese Patent Publication No. Sho. 58-500744), the drive mechanism for moving a workpiece is so designed as to provide two drive forces; that is, it has two electric motors for moving the work in one direction. Hence, the device is high in manufacturing cost. In addition, it is difficult to make the operations of the motors synchronous with each other.

The latter device (disclosed by Examined Japanese Patent Publication No. Hei. 1-45395) is free from the above-described difficulties, because the drive mechanism has only one electric motor. However, the moving drive rack is heavy. Therefore, the device is not suitable for moving a work at high speed. In addition, two stationary racks and one drive rack are arranged in parallel with one another. During installation it is rather difficult to arrange them in parallel with one another with high accuracy. Furthermore, the drive rack and its guide, being arranged substantially at the middle of the movable frame, may obstruct the replacement of the bobbin in the shuttle of the sewing machine.

SUMMARY OF THE INVENTION

In view of the foregoing problems due to limitations of the related art, the object of the present invention is to provide a work moving device for a sewing machine which is low in manufacturing cost, capable of moving a work at high speed, capable of being assembled with ease, and which will not obstruct the replacement of the bobbin in the shuttle of the sewing machine.

According to a first aspect, there is provided, in a sewing machine a work moving device which moves a work to be sewed with respect to a sewing needle which stitches a seam on the work. The work moving device includes: a pair of stationary racks spaced from each other, the stationary racks being set in parallel with each other in a first direction of moving the work; a coupling shaft having gears engaged with the stationary racks, respectively; a coupling shaft driver for rotating the coupling shaft; a movable frame rotatably supporting the coupling shaft, the movable frame being movable back and forth in the first direction according to rotating the coupling shaft; a carriage supported by the movable frame, the carriage being movable back and forth in a second direction perpendicular to the first direction; a carriage driver for moving the carriage back and forth in the second direction; and a pallet supported by the carriage, for carrying the work.

According to a second aspect, there is provided the device of the first aspect, wherein the coupling shaft driver includes: a first spiral gear secured to one end of the coupling shaft; a second spiral gear engaging with the first spiral gear; a drive shaft which is rotated together with the second spiral gear and slidably supporting the second spiral gear thereon; and an electric motor for rotating the drive shaft, so that the movable frame is moved back and forth in the first direction.

According to a third aspect, there is provided the device of the first aspect, wherein the coupling shaft includes two parts divided from each other and a joint mechanism for coupling the two parts thereof.

According to a fourth aspect, there is provided the device of the first aspect, wherein the coupling shaft includes two parts divided from each other and a double-shaft motor fixedly mounted on the movable frame, for coupling the two parts thereof.

In the work moving device thus constructed, only one driver is provided to move a work in one direction, and the heavy racks are not mounted on the moving body so that the parts to be moved are light in weight. In addition, only two stationary racks are required to be in parallel with each other, and the driving system for moving a work in the one direction is provided on one side of the sewing machine.

DETAILED DESCRIPTION OF THE PREFERRED EMBODIMENTS

The preferred embodiment of the invention will be described with reference to the accompanying drawings.

Figure 1:
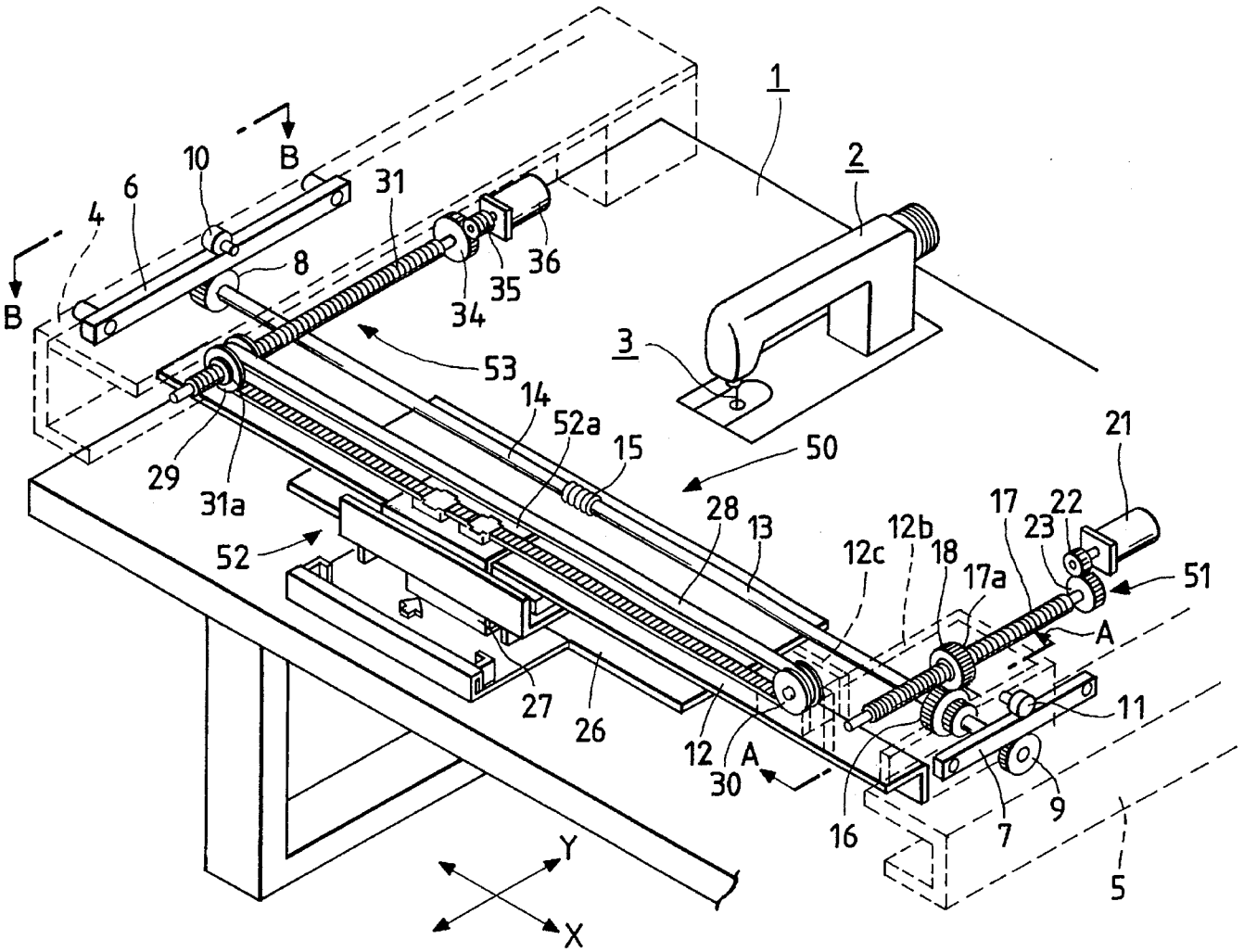
FIG. 1 is a perspective view of an electronic cycle sewing machine with a work moving device attached according to the present invention.
Figure 3:
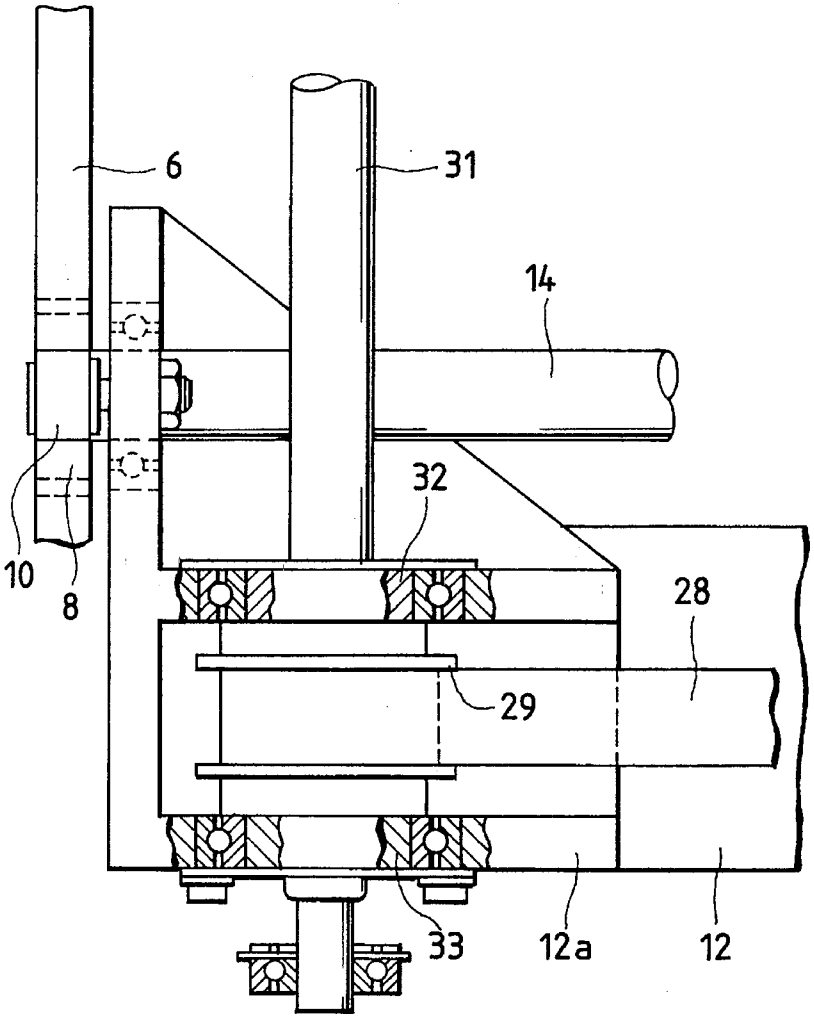
FIG. 3 is a plan view of the work moving device in the direction of the arrows along line B—B in FIG. 1.
Figure 2:
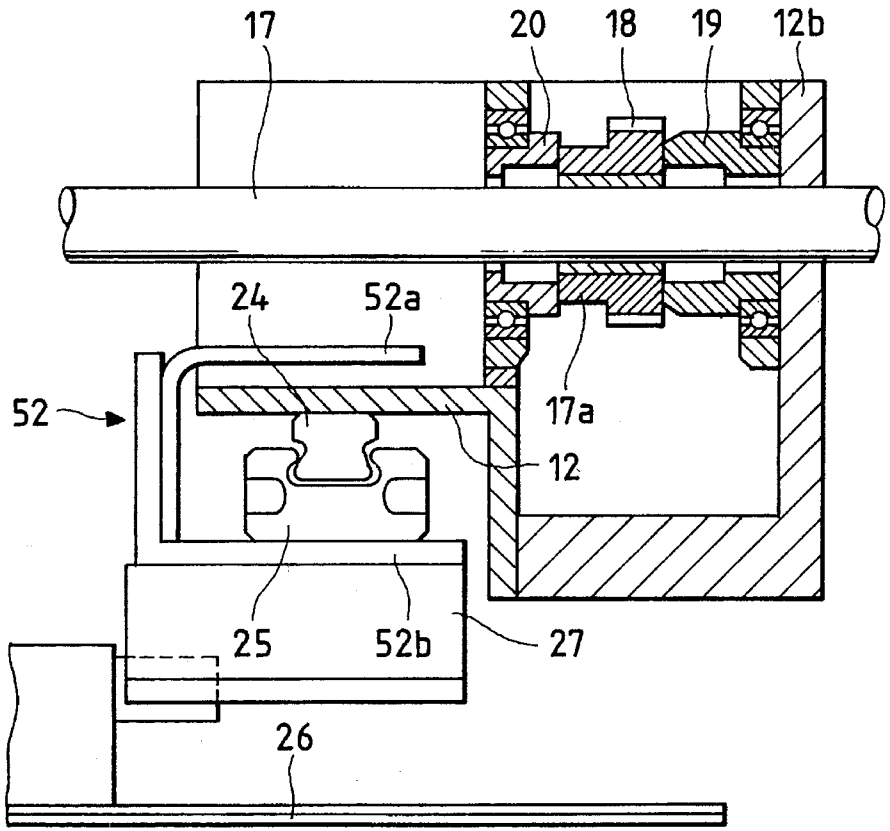
FIG. 2 is a side view, with parts cut away, of the work moving device in the direction of the arrows along line A—A in FIG. 1.

FIG. 1 is a perspective view of an electronic cycle sewing machine having a work moving device, which constitutes a first embodiment of the invention. FIG. 2 is a side view, with parts cut away, of the work moving device taken in the direction of the arrows along line A—A in FIG. 1. FIG. 3 is a plan view of the work moving device taken in the direction of the arrows along line B—B in FIG. 1. The electronic cycle sewing machine has the work moving device which, as described later, moves a work according to sewing data in a pattern stitching operation.

In FIG. 1, reference numeral 1 designates a machine stand, on which a sewing machine body 2 is mounted. The sewing machine body 2 has a shuttle (not shown) and a needle 3 serving as seam-forming means at the front end.

In front of the sewing machine body 2 and at right and left ends of the machine stand 1, supports 4 and 5 substantially U-shaped in section (indicated by the dotted lines for clarification in illustration) are fixedly provided in such a manner that they extends in a front-to-rear direction (or in the direction of Y-axis, or in a first direction). Stationary racks 6 and 7 are fixedly provided between those supports 4 and 5 in such a manner that they extends in a right-to-left direction.

In front of the sewing machine body 2, a coupling shaft 50 extends in the direction (or in the direction of X-axis) perpendicular to the direction of the stationary racks 6 and 7. The coupling shaft 50 is divided at the middle into two parts (hereinafter referred to as coupling shafts 13 and 14", when applicable). Those coupling shafts 13 and 14 are coupled to each other through a rigid shaft coupling 15. A gear 8 is fixedly secured to the left end of the coupling shaft 14, and a gear 9 is fixedly secured to the right end of the coupling shaft 13. Those gears 8 and 9 are engaged with the above-described stationary racks 6 and 7, respectively. Hence, even if the teeth of the right stationary rack 7 are shifted from those of the left stationary rack 6, with the aid of the rigid shaft coupling 15, the engagement of the stationary racks 6 and 7 with the gears 8 and 9 can be adjusted with ease. The coupling shafts 13 and 14 coupled to each other through the rigid shaft coupling 15 are much higher in rotation transmitting performance than those which are coupled to each other through a flexible coupling (such as an Oldham's coupling).

In front of the coupling shaft 50, a Y-axis movable frame 12 is extended in the direction of X-axis. As shown in FIGS. 1 and 3, protrusions 12*b* and 12*a* are provided at the right and left ends of the Y-axis movable frame 12, respectively (for clarification in illustration, the protrusion 12*a* is not shown in FIG. 1, and the protrusion 12*b* is indicated by the dotted lines). The above-described coupling shafts 14 and 13 are rotatably supported on the protrusions 12*a* and 12*b* through bearings, respectively. In addition, the Y-axis movable frame 12 has two other protrusions (not shown), on which the coupling shafts 14 and 13 are rotatably supported. That is, the coupling shaft 14 is rotatably supported by the protrusion 12*a* and one of the two protrusions (not shown), and the coupling shaft 13 is rotatably supported by the protrusion 12*b* and the other protrusion (not shown).

The stationary racks 6 and 7 are provided with cam followers (or rotary supports) 10 and 11 as follows: The shafts of the cam followers 10 and 11 are fixedly secured to the protrusions 12*a* and 12*b* above the supporting points where the coupling shafts 14 and 13 are supported, respectively (cf. FIGS. 1 and 3), and the rotary parts of the cam followers are in contact with the upper surfaces of the stationary racks 6 and 7, respectively. That is, the stationary rack 6 is held between the cam follower 10 and the gear 8, and the stationary rack 7 is held between the cam follower 11 and the gear 9, so that the stationary racks 6 and 7 are positively engaged with the gears 8 and 9, respectively.

A first spiral gear 16 is fixedly mounted on the end portion of the coupling shaft 13. The first spiral gear 16 is rotated by coupling-shaft rotating means 51 described below. The coupling-shaft rotating means 51 includes: a Y-axis drive motor 21 fixedly mounted on the machine stand 1; a reduction gear 23 engaged with a gear 22 which is fixedly mounted on the output shaft of the motor 21; a Y-axis drive shaft 17 coupled to one end of reduction gear 23 is secured in such a manner that the shaft 17 is rotatably supported on the machine stand 1 at both ends, the shaft 17 having splines between its both end portions; an outer cylinder 17*a* which is fitted on the splines of the Y-axis drive shaft 17 so that it is turned together with the shaft 17 and is slidable on the latter 17; a second spiral gear 18 which, as shown in FIG. 2, is fixedly mounted on the outer cylinder 17*a* with a key and is engaged with the above-described first spiral gear 16; and collars 19 and 20 which are provided on both sides of the second spiral gear 18, and rotatably supported by the protrusion 12*b* of the Y-axis movable frame 12.

As shown in FIG. 2, a guide rail 24 is fixedly mounted on the lower surface of the Y-axis movable frame 12 in such a manner that the guide rail 24 extends longitudinally of the Y-axis movable frame 12. In front of the guide rail 24 and the Y-axis movable frame 12, an X-axis movable frame 52 is provided as a carriage. The X-axis movable frame 52 is substantially U-shaped in section comprising upper and lower side boards 52*a* and 52*b* which are so arranged as to embrace the guide rail 24 and the Y-axis movable frame 12. A slide unit 25 is fixedly mounted on the lower side board 52*b*, and the aforementioned guide rail 24 slidably supports the slide unit 25.

A detachably connecting member 27 is fixedly mounted on the lower surface of the lower side board 52*b* of the X-axis movable frame 52. A pallet 26 bearing a work is detachably connected to the detachably connecting member 27. A part of a timing belt 28 is secured to the upper side board 52*a* of the X-axis movable frame 52. The timing belt 28 is laid over a driving sprocket 29 (on the left side of FIG. 1) and a driven sprocket 30 (on the right side of FIG. 1). The driven sprocket 30 is rotatably supported on a protrusion 12*c* formed on the Y-axis movable frame 12. In order to stretch the timing belt 28 tight, the driven sprocket 30 is so supported that it can be moved as required; for instance, it is held in a hole formed in the protrusion 12*c* which is elongated in the direction of X-axis.

The driving sprocket 29 is turned by timing belt driving means 53. The timing belt driving means 53, as shown in FIG. 1, comprises: an X-axis drive motor 36 fixedly mounted on the machine stand 1; a reduction gear 34 engaged with a gear 35 fixedly mounted on the output shaft of the X-axis drive motor 36; an X-axis drive shaft 31 coupled to one end of reduction gear 34 is secured in such a manner that the shaft 31 is rotatably supported on the machine stand 1 at both ends, the shaft 31 having splines between its both end portions; an outer cylinder 31*a* which is fitted on the splines of the X-axis drive shaft 31 so that it is turned together with the shaft 31 and is slidable on the latter 31; the above-described driving sprocket 29 which is secured to the outer cylinder 31 with a key; and collars 32 and 33 (as shown in FIG. 3) which are provided on both sides of the driving sprocket 29, and are rotatably supported by the protrusion 12*a* of the Y-axis movable frame 12.

The work moving device thus constructed operates as follows:

First, drive signals are applied to the Y-axis drive motor 21 and the X-axis drive motor 36 according to a sewing program provided for a given sewing pattern. As a result, motors 21 and 36 start rotation. As the Y-axis drive motor 21 is rotated, the rotation of the motor 21 is transmitted through the gear 22, the reduction gear 23 and the Y-axis drive shaft 17 to rotate the second spiral gear to 18 to. As the second spiral gear 18 is rotated in this manner, the first spiral gear 16 and the coupling shafts 13 and 14 are rotated. Hence, the gears 8 and 9, being engaged with the stationary racks 6 and 7, are moved in the direction of Y-axis, and the coupling shafts 13 and 14 are also moved in the direction of Y-axis. In this movement, the outer cylinder 17*a*, the second spiral gear 18, and the collars 19 and 20 are moved in the direction of Y-axis while being turned, so that the Y-axis movable frame 12 is moved in the direction of Y-axis. On the other hand, as the Y-axis movable frame 12 is moved in the direction of Y-axis in the above-described manner, the outer cylinder 31*a*, the driving sprocket 29, and the collars 32 and 33 are moved in the direction of Y-axis while sliding on the X-axis drive shaft 31. In association with the movement of the Y-axis movable frame 12, the X-axis movable frame 52, the detachably connecting member 27, and the pallet 26 are moved in the direction of Y-axis.

When the X-axis drive motor 36 is driven, the rotation of the motor 36 is transmitted through the gear 35, the reduction gear 34 and the X-axis drive shaft 31 to rotate the driving sprocket 29. As the driving sprocket 29 is rotated, the driven sprocket 30 is rotated, so that the timing belt 28 is moved in the direction of X-axis while the slide unit 25 is slid on the guide rail 24 in the direction of X-axis. Thus, the X-axis movable frame 52, the pallet supporting device 27, and the pallet 26 are moved in the direction of X-axis.

That is, the work can be moved to a desired position in the X-Y coordinate system.

As was described above, the embodiment comprises: one pair of stationary racks 6 and 7 which are spaced from each other in the direction of movement of the pallet 26 (in the direction of Y-axis) and are set in parallel with each other; the coupling shaft 50 having the gears 8 and 9 which are engaged with the stationary racks 6 and 7; the coupling shaft rotating means 51 for rotating the coupling shaft 50; the Y-axis movable frame shaft 12 which rotatably supports the coupling shaft and which is moved back and forth in the direction of Y-axis as the coupling shaft 50 is rotated; the carriage (or X-axis movable frame) 52 which is supported by the Y-axis movable frame 12 in such a manner as to be moved back and forth in the direction of X-axis; the means 53 for moving the carriage 52 back and forth in the direction of X-axis; and the pallet 26 which is supported by the carriage 52. That is, the work moving device of the invention employs only one drive mechanism to move the work in the direction of Y-axis. This feature contributes to a reduction of the manufacturing cost of the device. In addition, the feature eliminates the difficulty accompanying the conventional device that it is necessary to make the operations of the driving mechanism synchronous with each other. Accordingly, the device of the invention can be assembled with ease.

In addition, in the device of the invention, the present heavy racks are not mounted on the moving body; that is, the components to be moved are light. Hence, the device can be operated at high speed. Furthermore, in the device, only two stationary racks 6 and 7 are required to be in parallel with each other, which simplifies the assembling of the device.

The driving system for moving a work in the direction of Y-axis is provided on one side of the sewing machine; in other words, it is not provided ahead of it. Therefore, the bobbin in the shuttle can be readily replaced.

Furthermore, in the device, the coupling shafts 13 and 14 are coupled to each other through the rigid shaft coupling 15. Hence, even if the teeth of the stationary rack 6 are shifted from those of the stationary rack 6, the engagement of the gears 8 and 9 with those stationary racks 6 and 7 can be readily adjusted. The coupling shafts 13 and 14 coupled 15 each other through the rigid shaft coupling to are much higher in rotation transmitting performance than those which are coupled to each other through a coupling such as an Oldham's coupling.

The Y-axis drive motor 21, and the X-axis drive motor 36 alternatively may be mounted on the Y-axis movable frame 12. In this case, the Y-axis drive shaft 17, and the X-axis drive shaft (and accordingly their outer cylinders 17*a* and 31*a*) need not have the splines.

Figure 4:
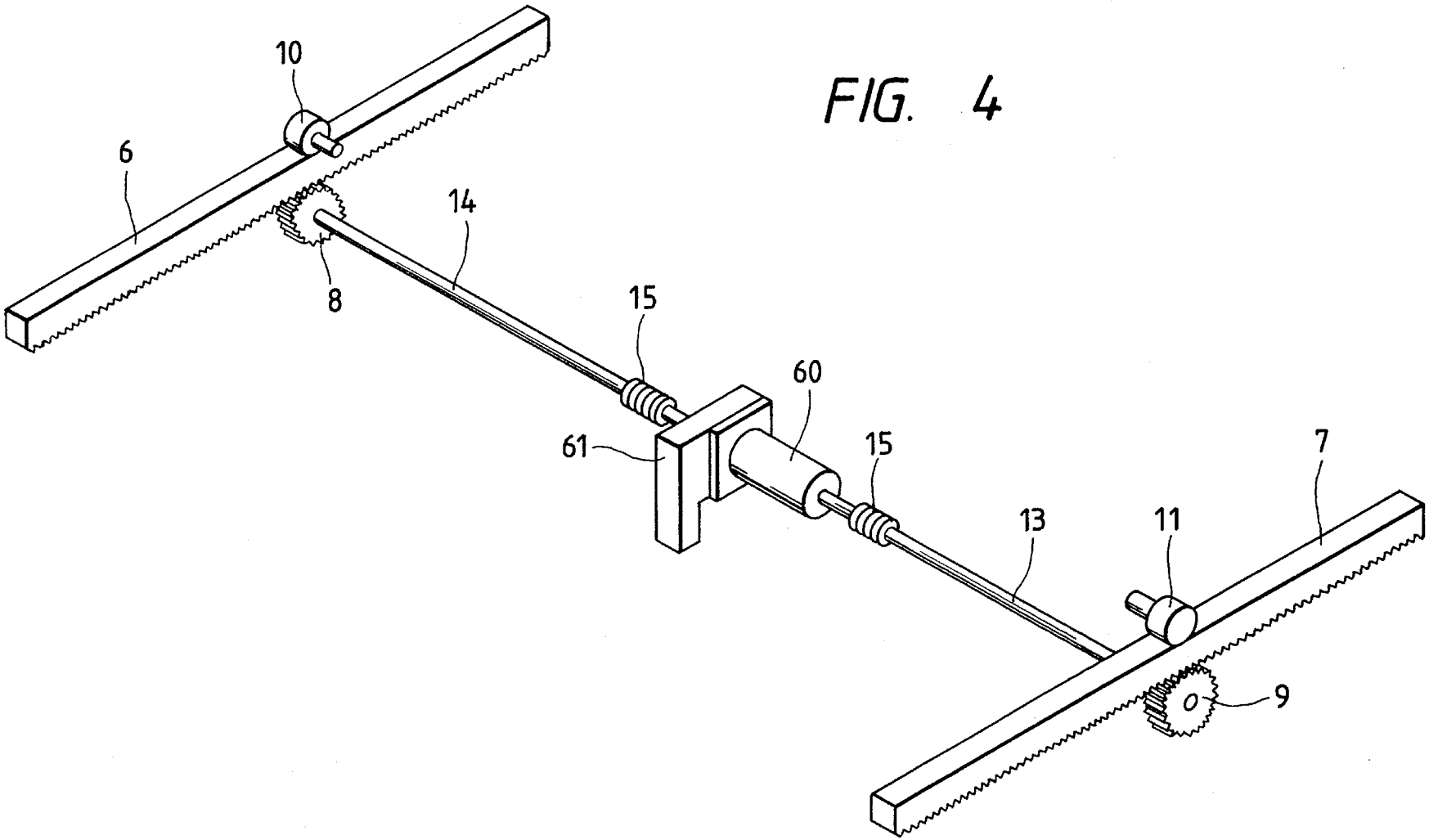
FIG. 4 is a perspective view showing skeletal structure of another example of the work moving device according to the present invention.

FIG. 4 is a perspective view showing essential components of another example of the work moving device, which constitutes a second embodiment of the invention.

The second embodiment is different from the first embodiment in that the coupling shafts 14 and 13 are connected respectively through two rigid shaft couplings 15 and 15 to a double-shaft motor 60. The double-shaft motor 60 is fixedly mounted on the Y-axis movable frame 12 by a bracket 61.

The second embodiment has the same effects as the first embodiment. In addition, the second embodiment dispenses with the first and second spiral gears 16 and 18 and the Y-axis drive shaft 17 which are essential for the first embodiment. This feature contributes to a reduction in the number of components. In addition, the feature provides the following effects: The resultant device is free from backlash, and is decreased in the number of manufacturing steps.

While there has been described in connection with the preferred embodiments of this invention, it will be obvious to those skilled in the art that various changes and modifications may be made therein without departing from the invention. In the above-described embodiments, the work moving device is applied to the electronic cycle sewing machine; however, it is also applicable to sewing machines other than the electronic cycle sewing machine.

In the work moving device thus constructed, only one drive mechanism is provided for moving a work in one direction. This feature contributes to a reduction in the manufacturing cost. In addition, the feature eliminates the difficulty accompanying the conventional device to make the operations of the driving means synchronous with each other. Accordingly, the device of the invention can be readily assembled.

In addition, in the device of the invention, the present heavy racks are not mounted on the moving body; that is, the parts to be moved are light. Hence, the device can be operated at high speed. Furthermore, in the device, only two stationary racks are required to be in parallel with each other, which simplifies the assembling of the device.

Finally, the driving system for moving a work in one direction is provided on one side of the sewing machine; in other words, it is not provided ahead of it. Therefore, the bobbin in the shuttle can be readily replaced.

What is claimed is:

1. A work moving device for a sewing machine which moves a work to be sewed with respect to a sewing needle which stitches a seam on the work, said work moving device comprising:

a pair of stationary racks spaced from each other, said stationary racks being set in parallel with each other in a first direction of moving the work;

a coupling shaft having gears engaged with said stationary racks, respectively;

coupling-shaft rotating means for rotating said coupling shaft, said coupling-shaft rotating means including, a first spiral gear secured to one end of said coupling shaft, a second spiral gear engaging with said first spiral gear, a first drive shaft which is rotated together with said second spiral gear and slidably supporting said second spiral gear thereon, and a first electric motor for rotating said first drive shaft;

a movable frame rotatably supporting said coupling shaft, said movable frame being movable back and forth in the first direction according to rotating said coupling shaft;

a carriage supported by said movable frame, said carriage being movable back and forth in a second direction perpendicular to the first direction;

means for moving said carriage back and forth in the second direction; and a pallet supported by said carriage, for carrying the work.

2. A work moving device according to claim 1, wherein said coupling shaft includes two parts divided from each other and a joint mechanism for coupling said two parts thereof.

3. A work moving device according to claim 1, wherein said coupling shaft includes two parts divided from each other and a double-shaft motor fixedly mounted on said movable frame, for coupling said two parts thereof.

4. A work moving device according to claim 1, wherein said coupling-shaft rotating means is disposed near one of said stationary racks.

5. A work moving device for a sewing machine which moves a work to be sewed with respect to a sewing needle which stitches a seam on the work, said work moving device comprising:

a pair of stationary racks spaced from each other, said stationary racks being set in parallel with each other in a first direction of moving the work;

a coupling shaft having gears engaged with said stationary racks, respectively;

coupling-shaft rotating means for rotating said coupling shaft;

a movable frame rotatably supporting said coupling shaft, said movable frame being movable back and forth in the first direction according to rotating said coupling shaft;

a carriage supported by said movable frame, said carriage being movable back and forth in a second direction perpendicular to the first direction;

means for moving said carriage back and forth in the second direction, said carriage moving means including, a driven sprocket rotatably secured on said carriage, a driving sprocket rotatably supported by said movable frame, a timing belt laid over said driven sprocket and said driving sprocket, a second drive shaft on which said driving sprocket is slidably connected, said second drive shaft being rotated together with said driving sprocket, and a second electric motor for driving said second drive shaft; and a pallet supported by said carriage, for carrying the work.

6. A work moving device according to claim 5, wherein said coupling shaft includes two parts divided from each other, and a joint mechanism for coupling said two parts thereof.

7. A work moving device according to claim 5, wherein said coupling shaft includes two parts divided from each other and a double-shaft motor fixedly mounted on said movable frame, for coupling said two parts thereof.

8. A work moving device according to claim 5, wherein said coupling-shaft rotating means is disposed near one of said stationary racks.

* * * * *